US005577298A

United States Patent [19]

Morell

[11] Patent Number: 5,577,298

[45] Date of Patent: Nov. 26, 1996

[54] CONDENSER AND METHOD OF THREAD-UP

[75] Inventor: Ricardo Morell, Barcelona, Spain

[73] Assignee: Hollingsworth Saco Lowell, Inc., Greenville, S.C.

[21] Appl. No.: 344,270

[22] Filed: Nov. 23, 1994

Related U.S. Application Data

[63] Continuation-in-part of Ser. No. 214,868, Mar. 17, 1994.

[51] Int. Cl.[6] ..... D01H 5/72; D01H 5/74

[52] U.S. Cl. ..... 19/288; 19/291

[58] Field of Search ..... 19/105, 288, 289, 19/291, 292; 57/315, 352; 226/196; 242/157 R, 157.1

[56] References Cited

U.S. PATENT DOCUMENTS

| | | | |
|---|---|---|---|
| 1,180,094 | 4/1916 | Williams . | |
| 1,313,164 | 8/1919 | Casablancas | 19/288 |
| 1,870,095 | 8/1932 | Casablancas . | |
| 1,926,475 | 9/1933 | Casablancas . | |
| 1,992,121 | 2/1935 | Casablancas . | |
| 2,091,209 | 8/1937 | MacGregor | 57/107 |
| 2,735,141 | 2/1956 | Tarbox | 19/288 X |
| 2,941,261 | 6/1960 | McCann . | |
| 3,273,206 | 9/1966 | Carroll | 19/288 |
| 3,276,719 | 10/1966 | Stetz . | |
| 3,537,145 | 11/1970 | Meert et al. | 19/288 X |
| 3,832,839 | 9/1974 | McClure | 57/1 R |
| 4,680,295 | 7/1987 | Bischofberger | 57/263 |
| 4,922,704 | 5/1990 | Slavik et al. | 57/704 |

FOREIGN PATENT DOCUMENTS

| | | | |
|---|---|---|---|
| 1310600 | 10/1962 | France | 19/291 |
| 359637 | 2/1962 | Switzerland | 19/291 |
| 140352 | 12/1960 | U.S.S.R. | 19/291 |

*Primary Examiner*—John J. Calvert

*Attorney, Agent, or Firm*—Leatherwood Walker Todd & Mann, P.C.

[57] ABSTRACT

A self-threading condenser for disposition within a drafting zone of a textile machine. The condenser includes a diminishing radii guide profile which directs a fiber strand contacting the guide profile into a fiber strand-carrying notch defined in the condenser. The condenser is allowed to float laterally in response to movements of strand passing through the drafting zone.

32 Claims, 4 Drawing Sheets

Fig. 1.
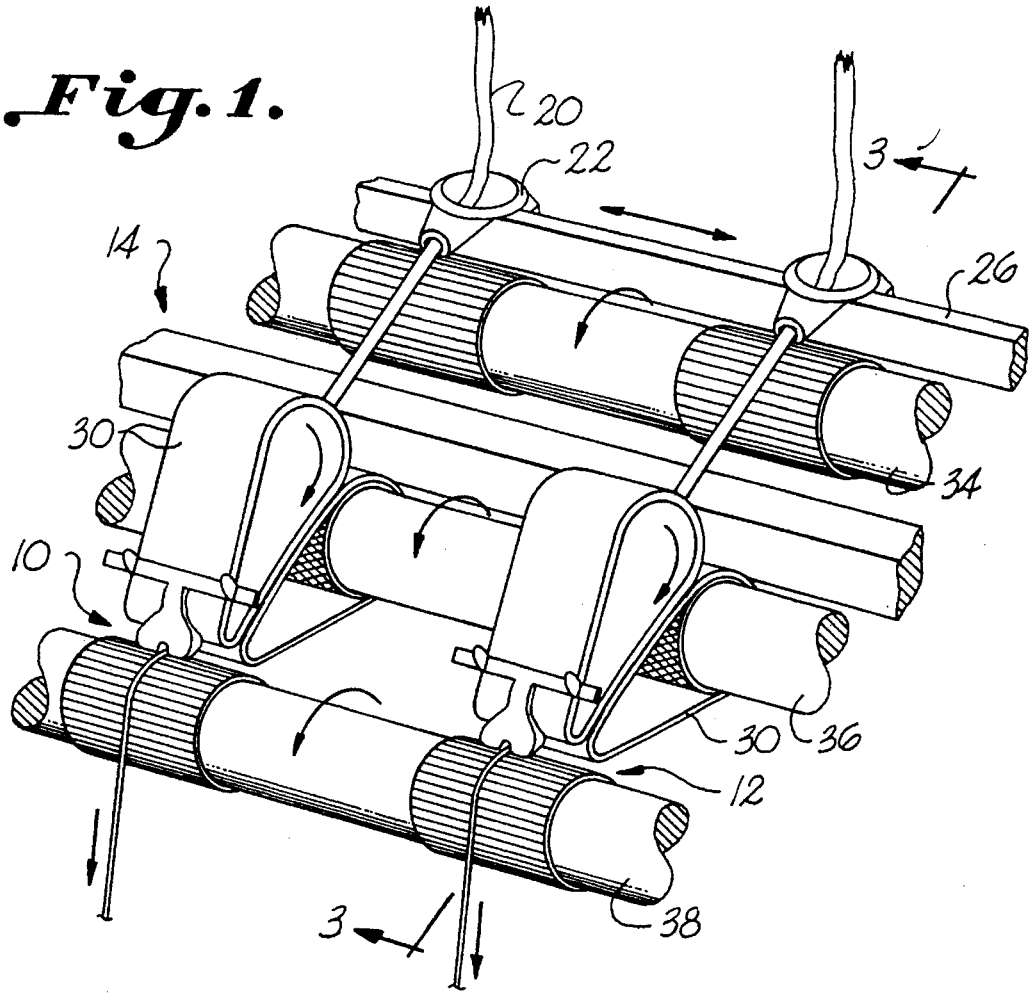
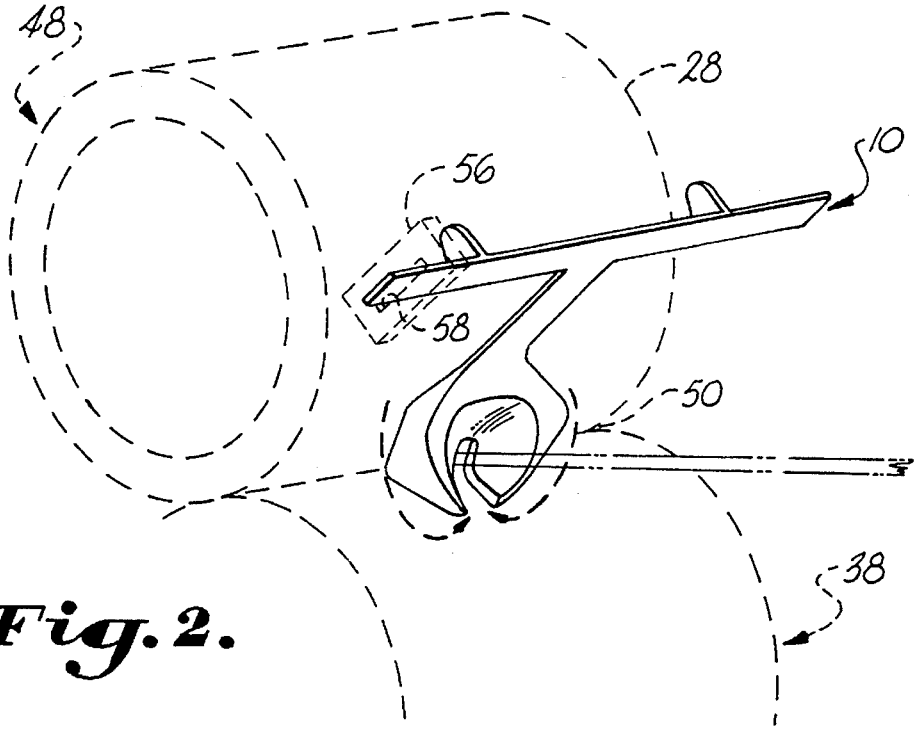
Fig. 2.

CONDENSER AND METHOD OF THREAD-UP

BACKGROUND OF THE INVENTION

This application is a continuation-in-part of co-pending U.S. patent application Ser. No. 08/214,868 filed Mar. 17, 1994.

This invention relates generally to a condenser for use for condensing fibers in a textile processing machine.

Condensers have been conventionally used in textile processing machines to make fibers being processed as coherent as possible prior to being spun into a yarn. Condensers are used to combine fibers to form a thinner stream from a relatively thick stream of fibers. Use of a condenser generally produces a stronger, less "hairy", and more uniform yarn from fiber strands as compared to when a condenser is not used.

Generally, condensers include a notch, or a series of notches, for receiving the fibers, the notches having surfaces for funneling the fibers together and for tapering the fibers into a cohesive band.

Conventionally, a band of fibers, known as "sliver" or "roving", is provided to a textile machine, such as a spinning machine, having a series of pairs of cooperating rollers, the roving or sliver passing between the roller pairs in nip zones provided at the interface of the rollers in each roller pair. Roving differs from sliver in that roving has a slight twist imparted to the fibers while sliver is generally untwisted and is generally what is fed to a typical textile processing machine, such as a spinning machine. However, sliver could also be fed to a spinning machine, although to do so, at least two drafting zones would generally be desired in the spinning machine, also known as a "spinning frame." The fiber strand is "drafted" between consecutive upstream and downstream pairs of rollers, known as "drafting rollers", which means that the fibers are pulled or stretched such that the fiber strand becomes elongated as it passes between the spaces between drafting roller pairs known as "drafting zones".

In a typical spinning machine, the terms "roving" and "sliver" are used to describe a fiber bundle up until it enters the spinning machine's drafting zones, where it is then simply known as a strand of fibers. Upon exiting the last of the drafting zones, the strand of fibers is imparted a twist and is known as "yarn".

Condensers have been designed for placement in such drafting zones, the condensers having a notch or opening through which the fiber strand passes in the drafting zone in order to keep the fibers together while in the drafting zone. It is inherent in the drafting operation that the downstream drafting roller pairs rotate at a faster rate than the upstream drafting roller pairs, thereby causing the fiber strand to stretch within the drafting zone. Because the fiber strand is undergoing changes due to the stresses placed upon it in the drafting zone, it is desirable to have the fiber strand pass through a condenser in order to enhance uniformity of the fiber strand as it passes through the drafting zone.

Generally, downstream from the final drafting zone, a bobbin is placed, which, in ring-type spinning, rotates as the yarn is twisted thereon, thereby imparting a twist in the roving being wound onto the bobbin and forming the yarn.

Numerous problems exist with conventional condensers. Generally, such condensers must be threaded by hand during start-up of the spinning machine, which is a labor intensive, tedious procedure. Additionally, should a fiber strand break during operation, it must then be re-threaded by hand. Further, if a condenser should fall out or move out of place during operation, a particular, or series, of fiber strands could pass through drafting zones without moving through a condenser, thereby changing the characteristics of such yarn produced as compared to yarn made from fibers which have passed through condensers. It is, therefore, important that if condensers are to be used in a spinning machine, every spinning station must have a properly threaded condenser in order to insure uniformity in all of the yarns produced by the machine.

Another feature typically found in a textile yarn spinning machine drafting system is that the rear guide through which the fibers pass, known generally as a "trumpet", is often designed to oscillate to and fro in order to equalize wear on the rubber or plastic sleeves or belts, known as "cots" provided on the drafting rollers. These flexible cots are what actually contact the fibers as the fibers pass through the nip zones of the drafting roller pairs. Because the cots are generally constructed of a flexible material, and because they are in constant contact with the fibers, there is a tendency for the cots to wear, and such wear is accelerated if the fibers are allowed to run against the same portion of the cots for an extended period of time. Therefore, the trumpet of the drafting system is generally oscillated slightly to and fro to allow the fibers to contact different portions of the cots, thereby equalizing wear on the cots' surfaces. This feature, however, could further complicate the thread up of a fiber strand after breakage in that the trumpet, as well as a condenser, would also have to be re-threaded.

Various condenser designs have been patented. U.S. Pat. Nos. 1,870,095; 1,926,475; and 1,992,121, all of which are issued to Casablancas, each disclose condensers attachable to a rod moveable into and out of a tube for allowing the distance between the condensers to be varied. U.S. Pat. No. 1,180,094, issued to Williams, discloses a guide for guiding fibers being unwound from bobbins. A flange is provided to aid in the piecing up of a broken yarn.

U.S. Pat. No. 4,680,295, issued to Bischofberger, et al., discloses an open-end yarn piercer having guide elements with yarn receiving slots for positioning yarn during a piecing operation. An edge of a guide directs the yarn towards a slot, and a mechanism is used to traverse the slot of the guide across the length of the yarn. U.S. Pat. No. 3,276,719, issued to Stetz, discloses a guide member having slots which converge towards end segments, which are adjacent to a teardrop-shaped slot. A traverse guide reciprocates for allowing contact of the guide plate with a yarn.

U.S. Pat. No. 2,941,261, issued to Stetz, discloses a drafting device having a condenser with an outwardly obliqued entrance edge. The condenser is reciprocable axially with respect to feed rolls. U.S. Pat. No. 4,922,704, issued to Slavik, et al., discloses a trumpet having a slot and a tab for allowing roving to be introduced laterally into the trumpet. U.S. Pat. No. 3,832,839, issued to McClure, discloses a slotted trumpet having a central opening for guiding a roving strand into a textile drafting system. Finally, U.S. Pat. No. 2,091,209, issued to MacGregor, discloses a threading device which includes an arm having a flared end for causing a thread, upon breakage, to wrap itself around the yarn instead of flying free.

While the foregoing condenser designs are known, there still exists a need for an economical and reliable condenser having the ability to automatically thread itself.

SUMMARY OF THE INVENTION

It is the principal object of this invention to provide a self-threading condenser for use in a textile processing machine.

It is another object of the present invention to provide a condenser which is allowed to experience lateral movement during operation.

It is another object of the present invention to provide a condenser having a diminishing radii fiber guide profile.

Still another object of the present invention is a condenser readily useable in a spinning machine having magnetic drafting rolls.

It is yet another object of the present invention to provide a condensing unit having two condensers, at least one of which is moveable with respect to the other.

It is still another object of the present invention to provide a condenser which attaches to an apron or cradle of a drafting roller mechanism.

Another object of the present invention is to provide a method of threading up a condenser.

Still further, it is an object of the present invention to provide a condenser which can project either upwardly or downwardly into a drafting zone.

Yet another object of the present invention to provide a condenser which will cause a predetermined breakage in a fiber strand in order to facilitate re-threading.

The present invention involves a condenser system which is automatically threaded up upon start-up of a textile fiber processing machine or after breakage of a sliver, roving, or fiber strand in a drafting zone of the machine. During thread-up of the condensing unit of the present invention, an end of a fiber strand ("strand end") will approach the condensing unit and will, ideally, pass directly through a slot or notch provided in the condenser. The fiber strand will then be picked up by the next downstream nip zone defined at the interface of the next downstream roller pair. If, however, the strand end does not pass initially through the condenser, it will tend to pass over one of the guide surfaces of the condensing unit, and will then be picked up by the nip of the next downstream drafting rollers anyway.

If the fiber strand passes over the condenser at one of these guide surfaces, it will tend to move along the guide surface towards the slot due to the fact that the fiber strand will try to achieve the shortest path in the draft zone between the immediately upstream drafting roller pair and the immediately downstream drafting roller pair, in relation to the location of the condenser. Preferably, the guide surfaces form peripheral profiles of diminishing radii centered about the centerline of the fiber strand as it passes through the condenser slot. The fiber strand, if initially passing over the guide surfaces during thread-up, will be urged by such diminishing radii profiles, or other angled profiles, into the condenser slot.

In an alternate embodiment wherein a condenser unit is mounted from its side within the drafting zone, such as when a dual condenser head system is used, the condenser head can be provided with a profile such that if the strand misses both the notch and the guide surfaces of the condenser during thread-up, then the fiber strand will contact a portion of the condensing unit deliberately designed to provide sufficient stress in the strand to break the strand. This breakage is caused by virtue of the longer route the strand must take in passing around such portion on its way to the next downstream pair of drafting rollers. The break is advantageous in that a new strand end is then formed, which should pass directly through the notch, or along one of the guide surfaces and eventually into the notch.

In a dual condensing head system, a connector, such as a rod, could be provided which allows one or both of the condensing units to float from side to side with respect to the rod to accommodate any lateral movement of the strand as it passes through a drafting zone.

More specifically, the present invention is drawn to a condenser for receiving a fiber strand in a textile fiber processing machine, the condenser comprising condenser means for receiving the fiber strand, and the condensing means defining a fiber passage for receiving the fiber strand. The condensing means defines at least one peripheral surface. Support means are provided which are connected to the condensing means for supporting the condensing means in the textile processing machine, and fiber guidance means which are associated with the condensing means are provided which automatically guide the fiber strand into the fiber passage upon contact of the fiber strand with the peripheral surface.

The present invention also includes a method for threading a condenser with a fiber strand, the method comprising providing a moving fiber strand in a textile fiber processing machine, and positioning a condenser adjacent the moving fiber strand such that the fiber strand contacts a peripheral guide surface of the condenser. The peripheral guide surface is configured such that it causes the fiber strand to migrate towards and into an open fiber passage defined in the condenser, thereby automatically threading the condenser.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 1 is a perspective view of condensers constructed in accordance with the present invention and disposed within a drafting zone of a textile machine;

FIG. 2 is a perspective view of a condenser constructed in accordance with the present invention;

DESCRIPTION OF THE PREFERRED EMBODIMENT

Figure 3:
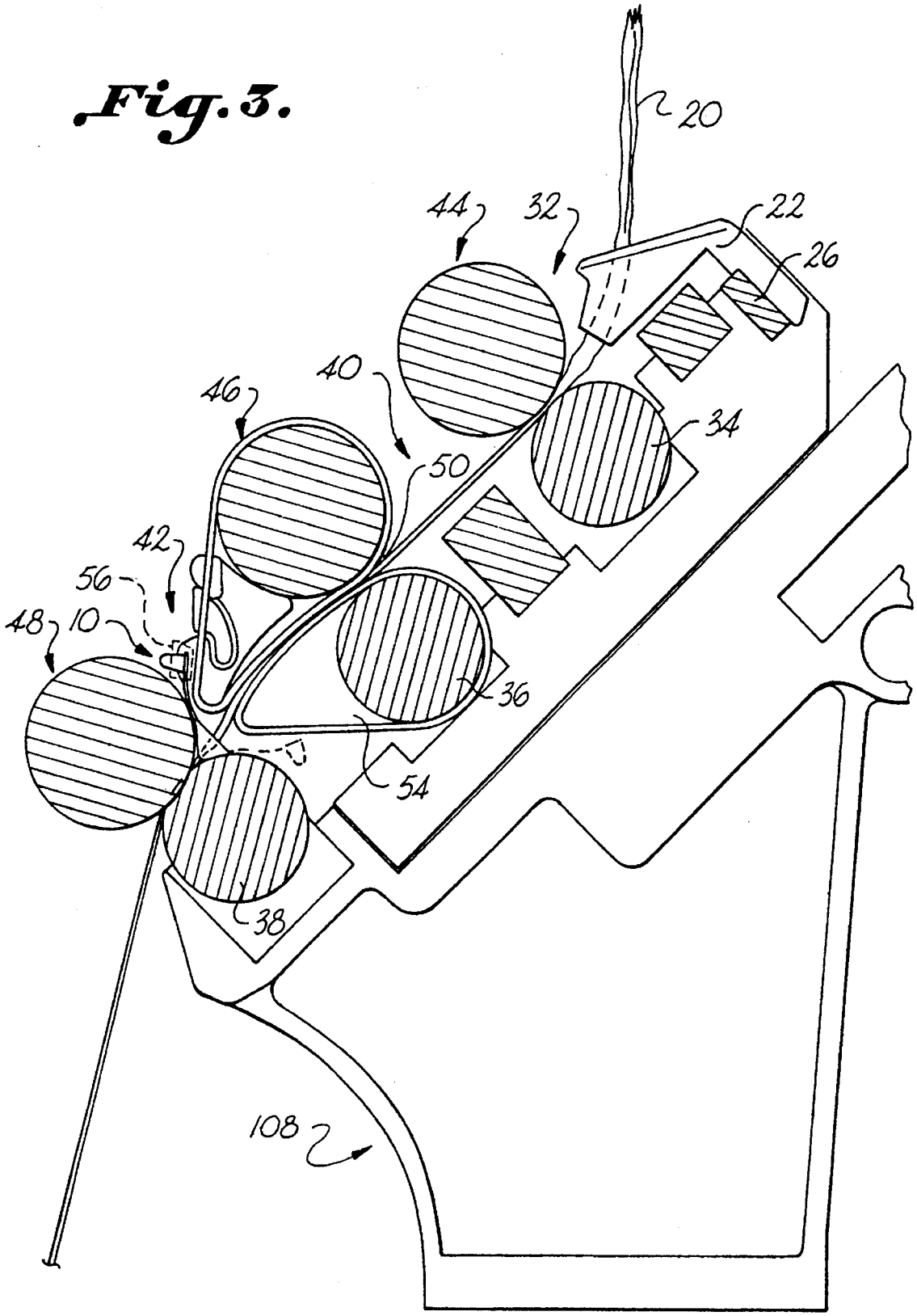
FIG. 3 is a sectional view, taken along lines 3—3 of FIG. 1.

The accompanying drawings and the description which follows set forth this invention in the best mode contemplated by the inventor at the time that the drawings and description were prepared. However, it contemplated that persons generally familiar with the art of textile manufacture will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the condenser means of the present invention is indicated generally in the figures by reference character 10.

The condenser means, or condenser, generally 10, of the present invention is illustrated in FIG. 1 of the drawings disposed in a final drafting zone 12 of a multi-staged drafting unit 14 provided on a conventional textile fiber processing machine, such as a yarn spinning machine. As indicated in FIG. 1, a strand of fibers 20, such as sliver, which is essentially untwisted fibers, or roving, which is a strand of fibers having a slight twist, enters the upstream side of the drafting unit 14, and eventually passes between trumpets 22 provided at the entry of the drafting system 14. In the embodiment shown in FIG. 1, the trumpets 22 are attached to a reciprocating bar 26 which a reciprocates the trumpet side to side in order to reduce the wear of cots 28, or belts 30, by directing the strand of fibers back and forth across the surfaces of such belts or cots in order to more equally distribute wear thereon. It is to be understood, however, that the condensers 10 of the present invention are not limited to use in a spinning machine having oscillating trumpets, as shown, but could also be used in configurations where the entry trumpets are not oscillated.

A simplified view of a drafting system is shown in FIG. 1, in that the drafting roller pairs, generally 32, shown in FIG. 3, are shown with only the lower rolls, generally 34, 36, 38, to clarify movement of the fiber strand through the drafting zones, generally 40, 42. A first drafting zone 40 is formed between upstream roller pair 44 and the next downstream roller pair 46. A second drafting zone 42 is formed between drafting roller pair 46 and a final drafting roller pair 48. It needs to be understood, of course, that more or less drafting zones could be formed, depending upon the number desired, and the present invention is not limited to the two drafting zone systems disclosed in the drawings. From the first roller pair 44, the fiber strand passes between a nip zone, generally 50, defined by belts 30 revolving about the stationary cradles, generally 54. The cradles 54 are in a greatly simplified form in order to accentuate the present invention, and as shown in FIG. 2, the cradles 54 may include upstanding ears 56 having windows 58 therein for supporting the condenser 10 for lateral movement in a manner to be described later. After passing between the rotating belts 30, the fiber strand is received by condenser 10, such as disclosed in the figures.

One version of a condenser constructed in accordance with the present invention is disclosed in FIGS. 1 through 6. This condenser is of a generally T-shape and includes a condenser head 60 having first and second transversely extending portions 62, 64 and having a fiber passage, or slot 68, defined therein. The first transversely extending portion 62 is the widest portion d1 of the condenser head 60, and the second transversely extending portion 64 is narrower in width d2 than the first portion and is in open communication with the fiber passage 68. Of particular importance is the fiber guidance means provided on the condensers for guiding the fiber strand into the fiber slot 68. On the peripheral portion of both sides of the condenser head, guide surfaces 72 are provided extending from the first transversely extending portion, or elbow 62, to the second transversely extending portion, or wrist 64. The guide surfaces taper inwardly towards the fiber slot as they run from the elbow 62 to the wrist 64. The guide surface 62 at the wrist portion 64 includes an upwardly turned surface 76 which angles inwardly to the fiber slot. The fiber slot has an open end 68, which communicates with the guide surface, a closed end 80 opposite the open end, and opposed sides 84.

As the fiber strand moves downstream through the condenser, it enters the nip zone of the final drafting roller pair prior to entering and being wound onto a rotating bobbin (not shown). As the fiber strand passes through the condenser, it defines a centerline 86 in the fiber slot. The guide surfaces of the condenser head are preferably diminished in relation to such fiber centerline 86 such that the distances from the fiber strand centerline, from the elbow portion 62 to the wrist portion 64 is a series of continuously diminishing radii centered about the fiber strand centerline.

The condenser shown more particularly in FIG. 2 and includes a vertical support member 88 depending from a horizontal support member, generally 90, which extends substantially perpendicularly to the horizontal support member 88. Outwardly extending from the horizontal support member 88 are limit means, or tabs 94, which are provided adjacent lateral movement means, such as wings 96, which extend through the window 58 or slot which can be provided in either an apron cradle or a separate support structure (not shown) extending downwardly or upwardly from a portion of the textile machine in proximity of a drafting zone. The window for receiving the condenser wings can, accordingly, be provided in a number of different configurations. It is not limited to being provided on apron cradles.

The wings 96 allow passive, lateral movement on the condenser from side to side. This is particularly important where an oscillating upstream trumpet is used in that the lateral movement capability of the condenser 10 allows for the condenser to track the side-to-side movement of the fiber strand as it passes through a drafting zone. It is also to be understood that while the condenser is shown in one drafting zone only, a condenser could be provided in each drafting zone, or instead in the upstream drafting zone, if desired.

It is important to note also that vertical member 88 is preferably somewhat flexible in order to allow the condenser head to "float" in the drafting zone, substantially within the path of travel of the fiber strand, as it receives the fiber strand in order to compensate for fluctuations in movement of the fiber strand, which can be caused by various factors.

Figure 4:
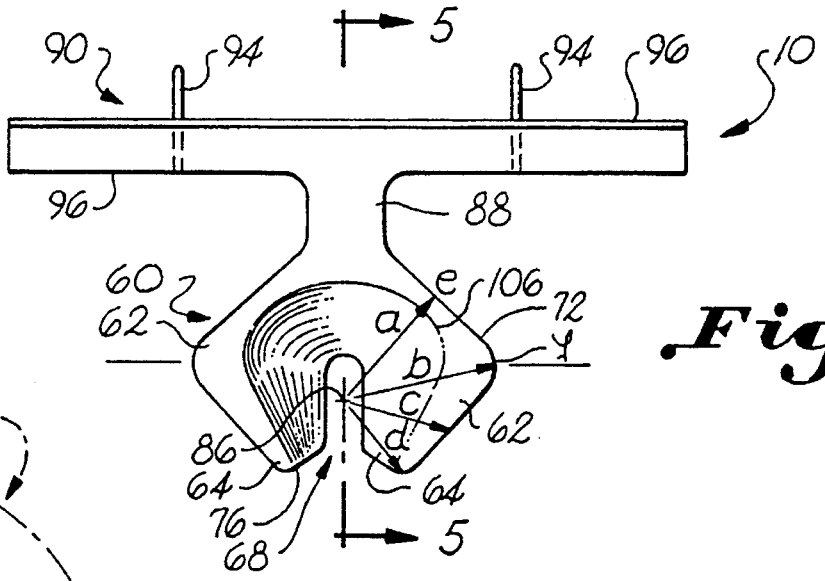
FIG. 4 is a frontal elevational view of the condenser constructed in accordance with the present invention.
Figure 6:
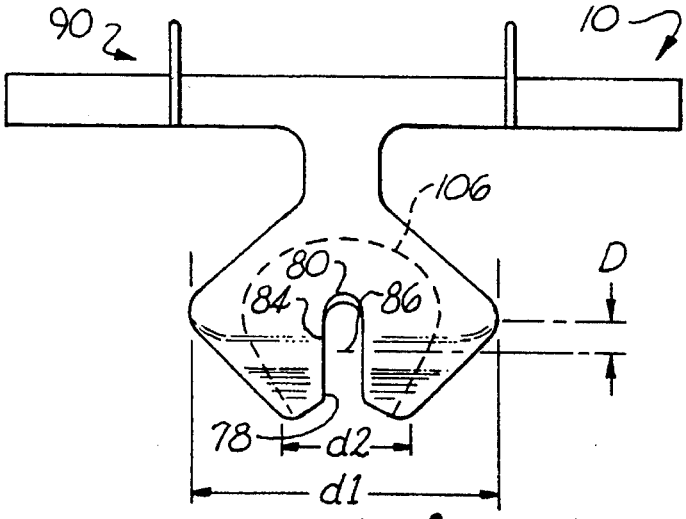
FIG. 6 is a rearward elevational view of a condenser constructed in accordance with the present invention.

Viewing the condenser as shown in FIG. 2 from the upstream side, the condenser includes a fiber entry side 98, as shown in FIGS. 2 and 4, and a fiber exit side 100 as generally shown in FIG. 6. The fiber entry side 98 includes a bowl-shaped cavity 104 of a depth B concentric about the fiber slot 68.

During operation, a fiber strand enters a drafting zone having a condenser 10, the fiber strand being propelled into the drafting zone by the immediately upstream drafting roller pair. The strand end of the fiber strand ideally will initially contact bowl-shaped cavity 104, which directs the strand end into the slot should the strand end impact on a particular portion of the cavity 104. In such a situation, the guide surfaces would not be used at all since the strand end would thread itself directly by means of impact with and redirection by the bowl-shaped cavity, which would direct the strand end into the guide slot.

However, should the strand end bypass the condenser 10 altogether and be received by the next downstream nip zone, the strand would contact and force the condenser 10 to the right or to the left, depending upon which side of the condenser which was adjacent to the moving strand. Engagement of the strand by the next downstream nip zone provides the necessary tension in the strand for allowing the side of the strand to shift the condenser during automatic threading. For example, if the side of the strand contacted the left side of the condenser, the condenser would be shifted to the right by the strand. The condenser would be moved in such a direction until further movement is restrained by the limit means, or tabs 94, which would impact the surfaces around the window 58. Then, because of the guide surfaces and, importantly, because the elbow portion 62 of the condenser is at an elevational D spaced away from the centerline of the strand slot, in a direction away from the open end 78 of the strand slot, the side of the strand will tend to migrate downwardly, as shown by the dotted arrows in FIG. 2, along the guide surfaces, as such guide surfaces would offer the shortest path between the upstream drafting roller pair and the downstream drafting roller pair bordering the draft zone. This is because the strand will inherently tend to find the shortest path between such roller pairs.

It is also to be understood that the guide surfaces are not only curved or angled about the fiber strand centerline of the fiber notch, but are also curved transversely inwardly towards a ridge defining the entry rim 106 to the bowl-shaped cavity 104. This complex curvature of the guide surfaces, both inwardly from the elbow to the wrist to the strand slot opening, and inwardly, in a more or less transverse direction towards the rim 106 of the bowl, serve to cause the strand to migrate downwardly, as shown in the configuration of FIG. 2, into the strand slot opening. It is to be emphasized that although the condenser is shown as extending downwardly from above the drafting zone, as shown in phantom in FIG. 3, the condenser could also be supported from below and extend upwardly into the draft zone.

The drafting system illustrated in FIG. 3 includes a frame, generally 108, for supporting the drafting roller pairs for rotation and also for supporting the trumpets 22 and oscillating bars 26 for movement with respect to the frame 104.

Figure 5:
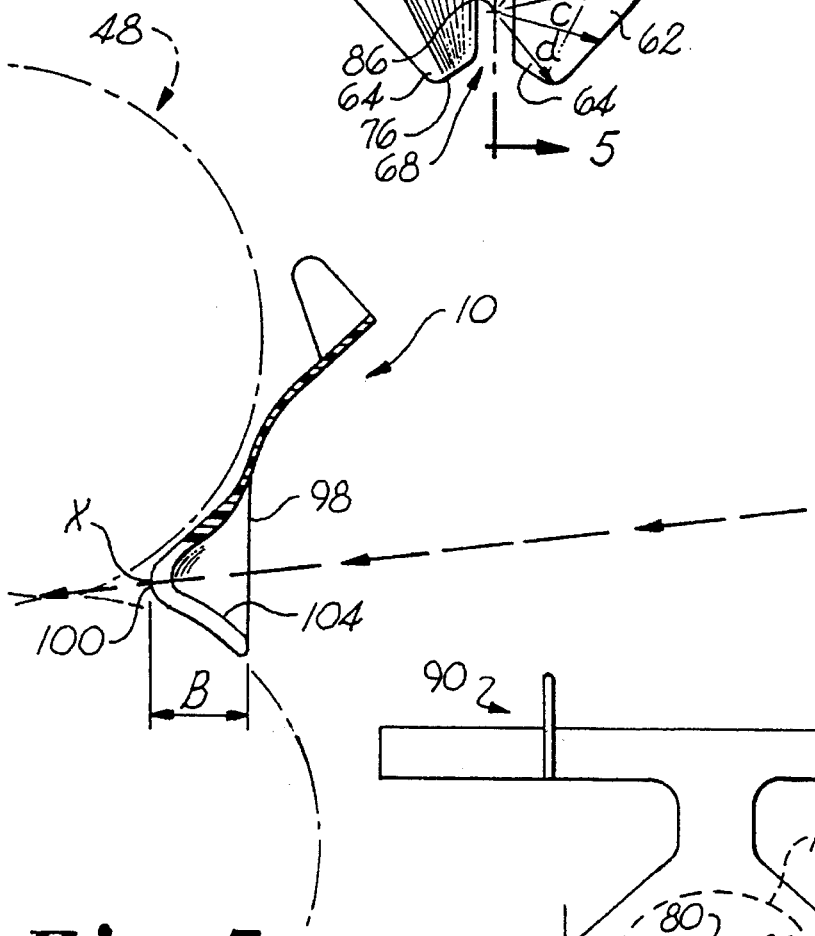
FIG. 5 is a sectional view, taken along lines 5—5 of FIG. 4.

FIG. 4 illustrates the diminishing radius profile of the guide surfaces 62, it being understood that the left and right sides of the condenser 10 are preferably mirror images of one another, the diminishing radius being indicated by arrows a, b, c, and d, each being a successively lesser dimension and each being centered about the designed centerline 86 of the fiber strand when the fiber strand passes through the fiber slot, such centerline being indicated also in FIG. 5.

FIG. 6 is a view of the condenser showing the distance, as identified by D, between the centerline of the fiber strand and the centerline, or widest portion 110, of the elbow portion 62 of the condenser. Because the elbow 62 is spaced above the centerline of the fiber strand, the strand, if passing adjacent the guide surface, at or below elbow 62, will tend to move downwardly in shortening the distance the strand has to travel between successive nip zones, and ultimately be directed into the strand slot provided in the condenser head. It is to be understood that peripheral surface configurations other than those illustrated can be provided for the condenser which would not depart from the teachings of this disclosure.

Additionally, if the strand should extend above the elbow portion 62 of the condenser, such as it point e, as illustrated in FIG. 4, the strand would still tend to migrate downwardly to the elbow portion and follow the peripheral guide surface 62 into the strand slot since the radius at point e, indicated by arrow a, is larger than the subsequent radii of the guide surface towards the strand slot opening.

Figure 8:
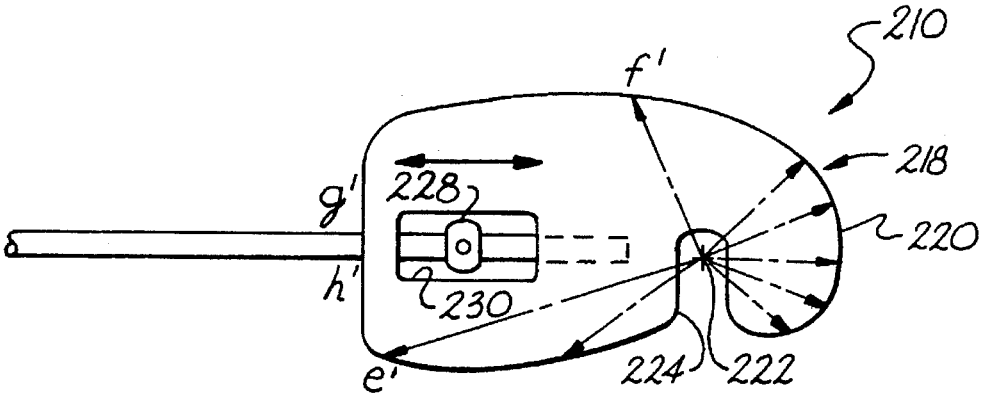
FIG. 8 is a fragmentary view of an alternate embodiment of a dual head condenser constructed in accordance with the present invention.
Figure 7:
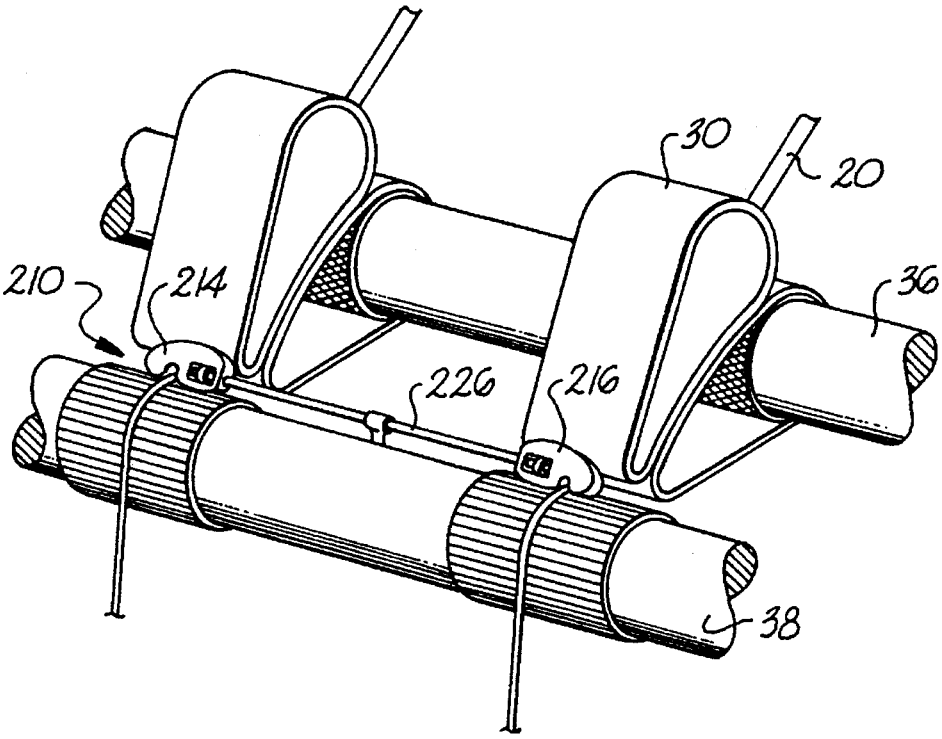
FIG. 7 is a partial perspective view of a dual head condenser constructed in accordance with the present invention and disposed within the drafting zone of a textile machine.

FIGS. 7 and 8 discloses an additional embodiment of a condenser constructed in accordance with the present invention, and is designated generally by 210. This dual head system incorporates similar features as is discussed above concerning condenser 10. Each condenser head 214, 216 is provided with guide surfaces, generally 218, each having a diminishing radii profile 220 centered around the strand centerline 222 and the condenser notch 224. Thus, during thread-up, should a strand contact the guide profile at point e', because of the diminishing radii surface centered about the strand centerline of the strand notch, the strand would migrate in a direction towards and ultimately into the strand slot. Likewise, should the strand initially contact the condenser head at point f', the strand will tend to migrate towards the strand slot due to the diminishing radii guide surface of the righthand portion of the condenser head. The lefthand portion of condenser head 216 is preferably a mirror image of the righthand portion of condenser head 214.

Should the strand initially contact the vicinity of point g' or h' of the condenser head, where a guide surface having diminishing radii periphery is not provided, the strand will be deliberately overstressed due to the elongated, bent path it must take to pass about the vicinity of points g' or h', thereby ultimately causing the strand to break. Once the strand breaks, a corresponding new strand end is formed, which would then, upon re-approaching the condenser head, likely contact the condenser head at a peripheral edge where the guide surface was of the diminishing radii configuration, which would ultimately direct the strand to the strand slot.

As shown in the embodiments in FIGS. 7 and 8, the supporting rod 226 between the two condenser heads 214, 216 can include a stop member, generally 228, which is provided within a window or cavity, generally 230, defined in the condenser head. Cavity 230 allows side-to-side movement of the condenser head with respect to the rod 226, within predetermined limits allowed by the stop member, within the boundaries of the window, such that the condenser can float with respect to side-to-side movement of the strand in the drafting zone. There are various other configurations which could be used to allow lateral movement of the condenser head with respect to the rod. Additionally, the condenser heads could be fixed with respect to the rod, and the rod allowed to move with respect to the drafting zone, if desired. Additionally, the condensers could be rigidly attached to the rod, and the rod rigidly attached to some other structure, thereby preventing relative movement of the condenser heads which respect to the rod, or the rod with respect to the drafting zone, if desired.

The condenser heads are preferably constructed of nylon. The condenser 10 is preferably of unitary construction formed entirely of nylon, and the condenser 210 could include nylon condensing heads and a rod of metal, plastic, or other suitable material or some other type of attachment structure. Alternately, the condensing heads of the condensers 10, 210, could be of multiple-part construction, and could include a wear-resistant portion which would define the strand receiving slot, constructed of a material such as Nylatron, or some other suitable metal, plastic, ceramic, etc. material, with the remaining part of the condenser head 10, 214, 216 of the condenser being formed by separate flexible material.

The condensers of the present invention can also include an upwardly extending finger-hold surface (not shown)

which would allow for easy insertion to a drafting zone by an operator using his or her fingers.

The condensers disclosed herein find particular use in drafting roller systems wherein magnetic drafting rollers are used, but it is to be understood that the condensers can also find widespread use in drafting systems which do not use magnetic rollers.

As discussed in my co-pending U.S. application Ser. No. 08/214,868, filed Mar. 17, 1994, the disclosure of which is incorporated herein by reference, condensers 10 are to be insertable in a drafting zone of a magnetic roller drafting system and are configured to "float" in that drafting zone during operation of the spinning frame. With respect to the magnetic roller design in my co-pending application incorporated by reference above, another feature has been noted which will be briefly discussed herein. In a standard spinning frame drafting system, there are three pairs of drafting rollers, namely, the fiber entry pair, the intermediate drafting pair, and the exit pair, each pair having a top and a bottom roll. In a magnetic roller-type drafting system using the magnetic top rollers of my co-pending application, wherein in one embodiment each magnetic roller is provided with a central pole piece having a magnet ring on either side thereof, it may be desirable for the orientation of the top roll magnets to be varied with respect to the other top rolls. For example, in one advantageous configuration, the polarity of the magnet rings adjacent the central pole member is reversed in the intermediate top roll with respect to the entry top roll, while the orientation of the magnet rings of the exit top roll is the same as intermediate top roll.

Stated differently for illustration purposes, in one example, both the intermediate and exit roller pair top rolls could have a central pole member with the south pole of each adjacent magnet ring facing the central pole member, while the entry roller pair top roll would have a central pole member with the north pole of each adjacent magnet ring facing the central pole member. Of course, the particular polarities used could be reversed on each of the rolls, if desired, so long as the relative relationship of polarities between top rolls is maintained as discussed above. This configuration is desired due to the interactive effects of magnetic forces of the magnetic rolls upon each other. The foregoing configuration would thus provide for an attraction of the entry and intermediate top rolls with respect to one another, and a repulsion of the intermediate and exit rolls with respect to one another (condenser 10 preferably being inserted in the drafting zone therebetween), thereby enhancing relative placement of the top rolls and further enhancing operation of the magnetic top roll drafting system. Orientation of the magnets could also be varied depending on the number of drafting roller pairs used, which may be more or less than the three pairs discussed above.

The condensers of the present invention, because of their independent construction and attachment within a drafting zone, are allowed to float freely and independently with the strand and with respect to one another, and because of their relatively easy insertion into the drafting zone, and self-threading capability, it is anticipated that they will find widespread use within textile drafting systems, thereby providing additional control of the strand in drafting zones, and ultimately, higher quality yarns and, consequently, fabrics.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A condenser for a fiber strand in a textile fiber processing machine, the condenser comprising:

condensing means for condensing the fiber strand; said condensing means defining an elongated fiber passage for receiving the fiber strand, said fiber strand in passage defining a fiber strand centerline, and said condensing means defining at least one peripheral surface; said fiber passage having an open end adjoining said peripheral surface; said condensing means including a first portion extending substantially perpendicular to said fiber passage positioned away from the fiber passage and having a first width; a second portion extending substantially perpendicular to said fiber strand centerline and having a second width; said first width being less than and expanding to said second width; said second portion narrowing to said open end of fiber passage; and said peripheral surface extending substantially continuously through said first portion and said second portion and terminating at said open end of said fiber passage; said peripheral surface being of a continuously diminishing radii curvature with respect to said fiber strand centerline, and wherein said peripheral surface directs the fiber strand into said fiber passage upon contact of the fiber strand with said peripheral surface; and support means connected to said condensing means for supporting said condensing means in the textile fiber processing machine.

2. The condenser as defined in claim 1, wherein said condensing means includes a fiber strand entry side and a fiber strand exit side substantially opposite said fiber strand entry side; said fiber strand entry side defining a substantially bowl-shaped cavity.

3. The condenser as defined in claim 2, wherein said bowl-shaped cavity defines said elongated fiber passage.

4. The condenser as defined in claim 1, wherein said condensing means is constructed of plastic and wherein said condensing means is of unitary construction with said support means.

5. The condenser as defined in claim 1, wherein said condensing means is constructed of metal.

6. The condenser as defined in claim 1, wherein said condensing means is constructed of ceramic material.

7. The condenser as defined in claim 1, wherein said fiber passage includes bordering surfaces of a first type of material and said condensing means is constructed of a second type of material.

8. The condenser as defined in claim 7, wherein said first type of material is an abrasion-resistant polymeric material and said second type of material is a flexible material.

9. The condenser as defined in claim 1, wherein said elongated fiber passage is an elongated slot having a closed end opposite said open end, and opposing side portions connected to said closed end.

10. The condenser as defined in claim 1, wherein said support means includes a substantially vertically extending portion extending from said condensing means and a substantially horizontally portion extending outwardly from said vertically extending portion.

11. The condenser as defined in claim 10, wherein said horizontally extending portion includes at least two free ends attachable to the textile fiber processing machine.

12. The condenser as defined in claim 1, wherein said support means is adapted for allowing lateral movement of said condenser means with respect to said textile fiber processing machine.

13. The condenser as defined in claim 12, wherein said support means includes limit means for limiting lateral movement of said condenser means within a predetermined range.

14. The condenser as defined in claim 13, wherein said limit means includes outwardly extending tabs on said support means for contacting a portion of the textile fiber processing machine.

15. The condenser as defined in claim 1, wherein said fiber guidance means includes said condenser means defining a bowl-shaped cavity substantially concentrically centered about said fiber passage.

16. The condenser as defined in claim 1, wherein said fiber guidance means includes:

lateral movement means associated with said condenser for allowing lateral movement of said condenser means by the fiber strand;

limit means associated with said lateral movement means for limiting movement of said condenser means; and said peripheral surface being for contacting the side of a fiber strand, and upon said limit means limiting movement of said condenser means, said peripheral surface directing the fiber strand into said fiber passage.

17. The condenser as defined in claim 1, wherein said condensing means has a transverse cross-section of generally diamond-shape.

18. A condenser for receiving a fiber strand in a textile fiber processing machine, the condenser comprising:

a condenser head for condensing the fiber strand; said condenser head defining a fiber strand slot for receiving the fiber strand, and said condenser head defining at least one peripheral guide surface; said fiber strand in said fiber slot defining a fiber slot centerline, said fiber slot having an open end adjoining said peripheral guide surface; said condenser head including a first portion extending substantially perpendicular to said fiber strand positioned away from the fiber slot and having a first width; a second portion extending substantially perpendicular to said fiber strand centerline of a second width; said first width being less than and extending to said second width; said second portion narrowing to said open end of said fiber slot; and said peripheral guide surface extending continuously through said first portion and said second portion and terminating at said open end of said fiber slot; said peripheral surface being of a continuously diminishing radii curvature with respect to said fiber strand centerline;

a support structure connected to said condenser head for supporting said condenser head in the textile fiber processing machine; and wherein said peripheral guide directs a fiber strand into said fiber slot upon contact of the fiber strand with said guide surface.

19. A condenser device for receiving a fiber strand in a textile fiber processing machine, the condenser device comprising:

a first condenser head and a second condenser head, each being for receipt of the fiber strand and each being elongated having a first end and a second end opposite said first end; said first and second condenser heads each defining a fiber passage proximate said first end for receiving a fiber strand, said fiber strand in each said fiber strand defining a fiber passage centerline; each of said first and second condenser heads including an upper surface and first and second lower surfaces substantially opposite said upper surface, said upper surface extending from said first end to said second end; said first lower surface extending from said first end to said fiber passage and said second lower surface extending from said fiber passage to said second end; said second end defining a substantially perpendicular surface portion adjacent each of said upper and first lower surfaces; each of said upper, first lower, and second lower surfaces being of a curvature of continuously diminishing radii with respect to said fiber strand centerline for automatically guiding a fiber strand into a respective fiber passage upon contact of the fiber strand with any one of said upper, first lower and second lower surfaces; and support means connected to each of first and second condenser heads for supporting each of said first and second condenser heads with respect to one another, and with respect to the textile fiber processing machine.

20. A condenser device as defined in claim 19, wherein said support means allows movement of at least one of said first and second condenser heads with respect to said support means.

21. A condenser device as defined in claim 19, wherein said support means allows movement of said first condenser head with respect to said second condenser head.

22. A condenser as defined in claim 19, wherein said second end of each of said first and second condenser heads includes means for breaking the fiber strand in the event the fiber strand should contact said second end.

23. A condenser as defined in claim 22, wherein said second end of said condenser head includes means for breaking the fiber strand in the event the fiber strand should contact said second end.

24. A condenser device as defined in claim 22, wherein said support means allows movement of said condenser head with respect to said support means.

25. A drafting system for a textile fiber processing machine for drafting a fiber strand, the drafting system comprising:

drafting means for receiving and carrying the fiber strand, said drafting means having an entry portion for receiving the fiber strand at a first speed and a delivery portion for delivering the fiber strand at a second speed, said second speed being faster than said first speed, such that the fiber strand is drafted between said entry and delivery portions;

said drafting means defining a drafting zone between said entry and delivery portions; and condenser means for condensing the fiber strand in said drafting zone; said condensing means defining a fiber passage for receiving the fiber strand, said fiber strand in said fiber passage defining a fiber strand centerline, and said condensing means defining at least one peripheral surface for contacting the fiber strands; said fiber passage having an open end adjoining said peripheral surface; said condensing means including a first portion extending substantially perpendicular to said fiber passage positioned away from the fiber passage and having a first width; a second portion extending substantially perpendicular to said fiber strand centerline and having a second width; said first width being less than and expanding to said second width; said second portion narrowing to said open end of fiber passage; and said peripheral surface extending substantially continuously through said first portion and said second portion and terminating at said open end of said fiber passage; said peripheral surface being of a continuously diminishing radii curvature with respect to said fiber strand centerline, and wherein said peripheral surface directs the fiber strand into said fiber passage upon contact of the fiber strand with said peripheral surface; and support means connected to said condensing means for supporting said condensing means in the textile fiber processing machine.

26. A method for threading a condenser with a fiber strand, said method comprising:

providing a moving fiber strand in a textile fiber processing machine;

positioning a condenser adjacent the side of said moving fiber strand; said condenser defining a fiber passage for receiving the fiber strand, said fiber strand in said fiber passage defining a fiber passage centerline, and said condenser defining at least one peripheral surface; said fiber passage having an open end adjoining said peripheral surface; said condenser including a first portion extending substantially perpendicular to said fiber passage positioned away from the fiber passage and having a first width; a second portion extending substantially perpendicular to said fiber strand centerline and having a second width; said first width being less than and expanding to said second width; said second portion narrowing to said open end of fiber passage; and providing a diminishing radii peripheral guide surface on said condenser extending substantially continuously through said first portion and said second portion and terminating at said open end of said fiber passage, such that said fiber strand contacts said peripheral guide surface and said peripheral guide surface causes said fiber strand to migrate towards and into an open fiber passage defined in said condenser, thereby automatically threading said condenser.

27. A method as defined in claim 20, further comprising:

moving said condenser laterally with said side of said fiber strand to initiate migration of said fiber strand along said peripheral guide surface.

28. A condenser for a fiber strand in a textile fiber processing machine, the condenser comprising:

condensing means for condensing the fiber strand; said condensing means defining a fiber passage for receiving the fiber strand, and said condensing means defining at least one peripheral surface;

support means connected to said condensing means for supporting said condensing means in the textile fiber processing machine; said support means including a substantially vertically extending portion extending away from said condensing means and a substantially horizontally extending portion extending outwardly from said vertically extending portion; and fiber guidance means associated with said condensing means for automatically guiding the fiber strand into said fiber passage upon contact of the fiber strand with said peripheral surface.

29. A condenser for a fiber strand in a textile fiber processing machine, the condenser comprising:

condensing means for condensing the fiber strand; said condensing means defining a fiber passage for receiving the fiber strand, and said condensing means defining at least one peripheral surface;

support means connected to said condensing means for supporting said condensing means in the textile fiber processing machine and for allowing lateral movement of said condenser means with respect to the textile processing machine, and said support means including limit means for allowing substantially vertically extending portion extending away from said condensing means and a substantially horizontally extending portion extending outwardly from said vertically extending portion; and fiber guidance means associated with said condensing means for automatically guiding the fiber strand into said fiber passage upon contact of the fiber strand with said peripheral surface.

30. A condenser for a fiber strand in a textile fiber processing machine, the condenser comprising:

condensing means for condensing the fiber strand; said condensing means defining a fiber passage for receiving the fiber strand, and said condensing means defining at least one peripheral surface;

support means connected to said condensing means for supporting said condensing means in the textile fiber processing machine;

lateral movement means associated with said condensing means for allowing lateral movement of said condenser means by the fiber strand;

limit means associated with said lateral movement means for limiting movement of said condensing means;

said peripheral surface being for contacting the side of a fiber strand, and upon said limit means limiting movement of said condenser means, said peripheral surface directing the fiber strand into said fiber passage; and fiber guidance means associated with said condensing means for automatically guiding the fiber strand into said fiber passage upon contact of the fiber strand with said peripheral surface.

31. A method for threading a condenser with a fiber strand, said method comprising:

providing a moving fiber strand in a textile fiber processing machine;

positioning a condenser adjacent the side of said moving fiber strand;

providing a diminishing radii peripheral guide surface on said condenser; and moving said condenser laterally with said side of said fiber strand to initiate migration of said fiber strand along said peripheral guide surface such that said fiber strand contacts said peripheral guide surface and said peripheral guide surface causes said fiber strand to migrate towards and into an open fiber passage defined in said condenser, thereby automatically threading said condenser.

32. A condenser device for receiving a fiber strand in a textile fiber processing machine, the condenser device comprising:

a condenser head for receipt of the fiber strand, said condenser head being elongated having a first end and a second end opposite said first end; said condenser head defining a fiber passage proximate said first end for receiving a fiber strand, said fiber strand in said fiber passage defining a fiber strand centerline; said condenser head including an upper surface and first and second lower surfaces substantially opposite said upper surface, said upper surface extending from said first end to said second end; said first lower surface extending from said first end to said fiber passage, and said second lower surface extending from said fiber passage to said second end; said second end defining a substantially perpendicular surface adjacent said upper and first lower surfaces; each of said upper, first lower, and second lower surfaces being of a curvature of continuously diminishing radii with respect to said fiber strand centerline for directs a fiber strand into said fiber passage upon contact of the fiber strand with any one of said upper, first lower, and second lower surfaces; and support means connected to said condenser head for supporting said condenser head with respect to the textile fiber processing machine.

* * * * *